US007927226B1

(12) United States Patent
Twitty

(10) Patent No.: US 7,927,226 B1
(45) Date of Patent: Apr. 19, 2011

(54) GOLF PUTTER HAVING ALIGNMENT APPARATUS

(76) Inventor: Howard A. Twitty, Scottsdale, AZ (US)

( * ) Notice: Subject to any disclaimer, the term of this patent is extended or adjusted under 35 U.S.C. 154(b) by 0 days.

(21) Appl. No.: 12/359,425

(22) Filed: Jan. 26, 2009

(51) Int. Cl.
*A63B 69/36* (2006.01)

(52) U.S. Cl. ..... 473/251; 473/254

(58) Field of Classification Search ..... 473/219–255, 473/340, 341
See application file for complete search history.

(56) References Cited

U.S. PATENT DOCUMENTS

| | | | | | |
|---|---|---|---|---|---|
| 3,549,300 | A | | 12/1970 | Pelz | |
| 3,880,430 | A | | 4/1975 | McCabe | |
| 4,043,562 | A | * | 8/1977 | Shillington | 473/254 |
| 4,077,633 | A | * | 3/1978 | Studen | 473/251 |
| 4,136,877 | A | | 1/1979 | Antonious | |
| 4,340,229 | A | * | 7/1982 | Stuff, Jr. | 473/240 |
| 4,919,428 | A | | 4/1990 | Perkins | |
| 4,986,544 | A | | 1/1991 | Benson | |
| 5,052,690 | A | | 10/1991 | Sharp | |
| 5,248,145 | A | | 9/1993 | Brown | |
| 5,462,279 | A | | 10/1995 | Culpepper | |
| 5,538,249 | A | | 7/1996 | Benson | |
| 5,564,990 | A | | 10/1996 | Weeks | |
| D408,066 | S | | 4/1999 | Gurrola | |
| 5,921,868 | A | * | 7/1999 | DiMartino | 473/254 |
| 6,062,986 | A | | 5/2000 | Kaise | |
| 6,383,089 | B1 | | 5/2002 | Bonneau | |
| 6,394,910 | B1 | | 5/2002 | McCarthy | |
| 7,052,409 | B2 | * | 5/2006 | Goldsmith | 473/242 |
| 7,083,524 | B2 | | 8/2006 | Daniels | |
| 7,226,362 | B1 | * | 6/2007 | Schell et al. | 473/238 |
| 7,341,526 | B2 | | 3/2008 | McCarthy | |
| 2006/0258475 | A1 | * | 11/2006 | Lee | 473/226 |
| 2006/0276259 | A1 | | 12/2006 | Cameron | |

* cited by examiner

*Primary Examiner* — Sebastiano Passaniti
(74) *Attorney, Agent, or Firm* — Gallagher & Dawsey Co., LPA; Michael J. Gallagher; David J. Dawsey

(57) ABSTRACT

A putter head is provided which has a striking surface and is adapted to mount to a shaft of a putter. The putter head has an alignment apparatus which includes a sighting device and a flat surface. The sighting device has an upright element and a base element which is symmetrically positioned around a bottom of the upright element. When viewed from above, centering the base element around the upright element every time positions a golfer's eyes and head in the same position every time. The flat surface is centered under the upright element. The flat surface whereby positioning the flat surface on a surface positions the putter head in the same relationship with the surface every time.

16 Claims, 5 Drawing Sheets

GOLF PUTTER HAVING ALIGNMENT APPARATUS

TECHNICAL FIELD

This invention relates generally to the field of golf, and, more particularly, to an alignment apparatus for a golf club confirming the placement of a user's eyes and head in the optimal position with respect to the putter head prior to each and every putt and placing the putter head in the same relationship to the ground every time.

BACKGROUND OF THE INVENTION

One of the most important, and most difficult skills, in the game of golf is putting. To be a good putter, one must master the skills of reading the greens, adjusting the amount of force applied by the club to the ball to reach the hole and aligning the putting head to the golf ball to direct the golf ball in the optimal direction. The present invention is an alignment apparatus which allows a user to place his or her eyes and head in the same spatial relationship with respect to the putter head every time. In addition, the putter head is positioned in the same relationship to the ground every time it is used.

Thus, there are a number of such alignment apparatuses in the prior art. U.S. Pat. No. 7,341,526 entitled "Golf Putter Having Alignment Aid For Aligning a Golfer's Head in at Least Four Axes" which issued on Mar. 11, 2008 to McCarthy provides an alignment aid for aligning a golfer's head with the putter and the ball. A central rear surface 114 is substantially parallel to putting face 108 and defines a forward boundary of cutaway region 116. A lower alignment pin 118 is disposed in the central rear surface and projects rearwardly therefrom into the cutaway region. An upper alignment pin 120 is disposed above the lower alignment pin and also projects rearwardly from the central rear surface into the cutaway region. The lower and upper alignment pins could be the same or a similar color, however, optimally a contrast in color between the two is desirable. The exact positions of the lower and upper alignment pins on the central rear face depends upon the geometry of putter head 104 and, to some extent, to the exact needs or preferences of a particular golfer. Regardless of the exact positions of the alignment pins, their relative positions are established such that when a golfer with his or her head is directly over the ball and sights down sight line 112, the golfer may quickly and repeatedly place his or her head in exactly the same spot directly over the ball 102. This head placement repeatability has been found to significantly improve putting accuracy.

U.S. Pat. No. 5,538,249 entitled "Golf Putter Head" which issued on Jul. 23, 1996 to Benson shows a flat horizontal flange 26 with a raised strip or marker 28 which extends perpendicularly to the striking face 21. The marker may consist of any line, groove or any other marking or symbol formed on the flange which is visible to the golfer. The putter head also includes a horizontal beam or protrusion 30. The protrusion extends outwardly from the upper edge of the rear face, perpendicular to the striking face and is spaced above the flange and marker. In a stance, a golfer can instantly and accurately determine if the putter head is parallel to putting surface 6 as the golfer's view of the marker is obstructed by the protrusion only when the sole of the putter head is parallel to the putting surface.

U.S. Pat. No. 3,880,430 entitled "Golfer Club Including Indicators For Aligning Golfer's Head Relative Thereto" which issued on Apr. 29, 1975 to McCabe discloses a putter with two interactive alignment indicators. Along the upper edge of the club head 22 is a flat area 31 in which there is located as straight line or groove 32. At about the center of the club head, opposite that part of the face which is intended to strike the ball, is a rearward extension 33 having a line or groove 34 which is perpendicular to the line 32. The extension extends from a tapered flange 35 which extends rearwardly from the face. A pair of lines or grooves 36 are located on the tapered flange, on to either side of the rearward extension. The lines 36 are parallel to line 34 and are located equidistant from either side. To use, the golfer adjusts the putter to more or less level on the green positioning his head thereabove so that the line 34 will appear to be precisely midway between the pair of lines 26.

U.S. Pat. No. 4,986,544 entitled "Golf Putter" which issued on Jan. 22, 2991 to Benson has a golf putter utilizing a light colored strip of tape 26 located on bottom flange 28 of putter head 10 between weighted end portions 20 and 22. The strip is located with its terminal edges equidistant from the sweet spot of the club head designated by dark line 18. A block 24 of any suitable material or shape is affixed to the head and located in the geometric center of the strip. The block has side walls 36 and 38 and one or more end walls 40. The end walls include line 18 to assist the golfer with target line selections and to identify the sweet spot. As shown, the dark line 18 is bordered by light colored lines 42. Each side wall is similar in color to line 18. When a golfer is properly positioned, the golfer will only see lines 18 and 42.

U.S. Pat. No. 6,394,910 entitled "Golf Putter for Aligning Player's Head" which issued on May 28, 2002 to McCarthy provides a putter with a golf head having visual indicator guides for aligning the player's head with the club head, ball and the cup. The guides are provided by distinguishable, colored surfaces that project the appearance of one or more pairs of alignment lines to the golfer's eye, despite the fact that no marking exist to conform to USGA rules. Club head 16 has two identical white concave surfaces 22 formed in its outermost dies and around the cutout section of the club head. Top surface 14 is a dark or black color. When viewed properly from above, the white concave surfaces project what appears to be two thin lines 24 and 26 towards the golfer's eye which assist in aligning the head to the club face, the ball and the cup.

U.S. Pat. No. 5,462,279 entitled "Golf Club Capable of Selective Angle Modification Between the Hosel and Head, and Selective Shaft Length and Method of Assembling the Golf Club" which issued on Oct. 31, 1995 to Culpepper has a putter with a club head 1 having a protrusion 5 with a line 29 serving as an alignment aid as an integral part of the head extending from the center of the rear side 9 thereof.

None of the cited references provide an alignment apparatus which allows a user to place his or her eyes and head in the same position with respect to the putter head every time and positions the putter head in the same relationship to the ground every time it is used. Thus, none of the known prior art disclose the combination set forth herein.

SUMMARY OF THE INVENTION

It is an object of this invention to provide an alignment apparatus which allows a user to place his or her eyes and head in the same position with respect to the putter head every time.

It is an further object of this invention to provide and alignment apparatus in which the user's eyes and head and the putter head are positioned simultaneously in the same relationship to the ground every time it is used.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
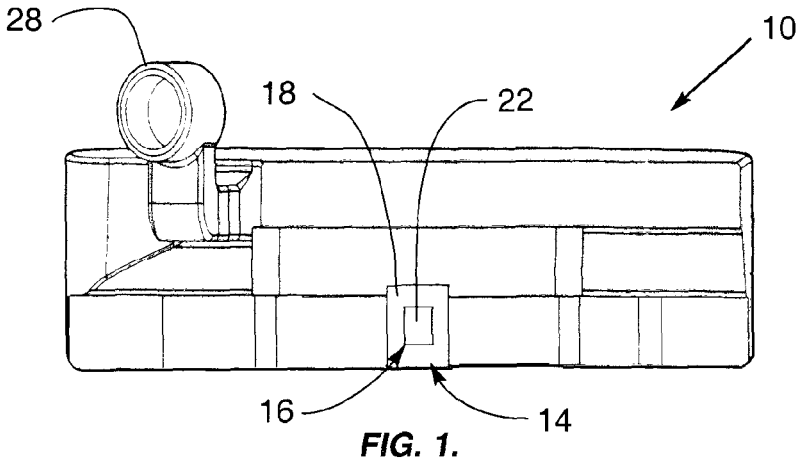
FIG. 1 is a top view of the present invention.

Referring more particularly to the drawings by characters of reference, FIGS. 1-5 and 8 disclose combinations of features which constitute a generic putter head 10 having an alignment apparatus comprising a vertical sighting device 12 and a flat surface 14. As shown, sighting device 12 has an upright element 16 and a base element 18 which surrounds a bottom 20 of upright element 16. Upright element 16 is preferably fixed to the putter directly behind the center of percussion or sweet spot 25.

Figure 6:
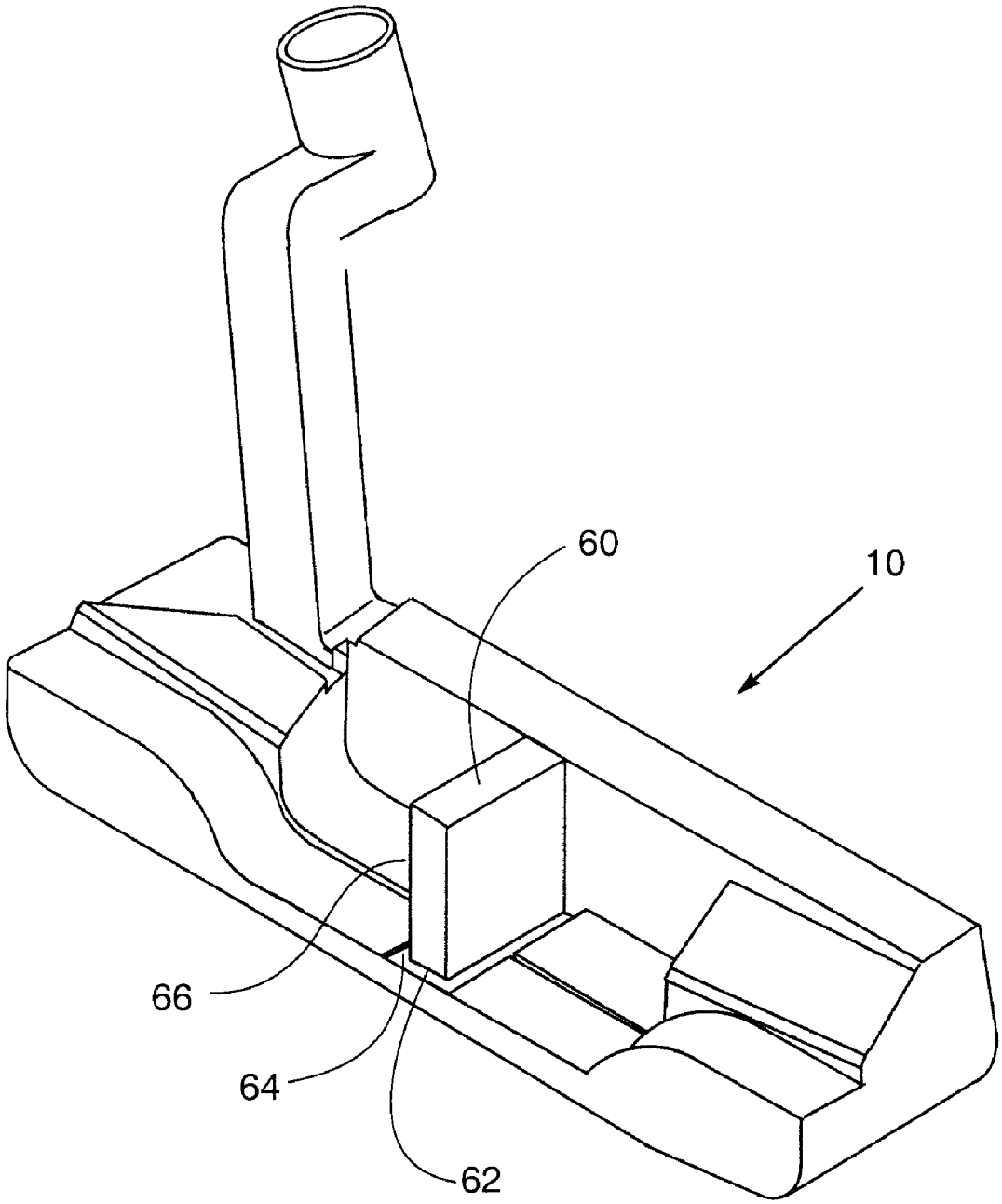
FIG. 6 is a perspective view of an alternate embodiment of the invention.
Figure 7:
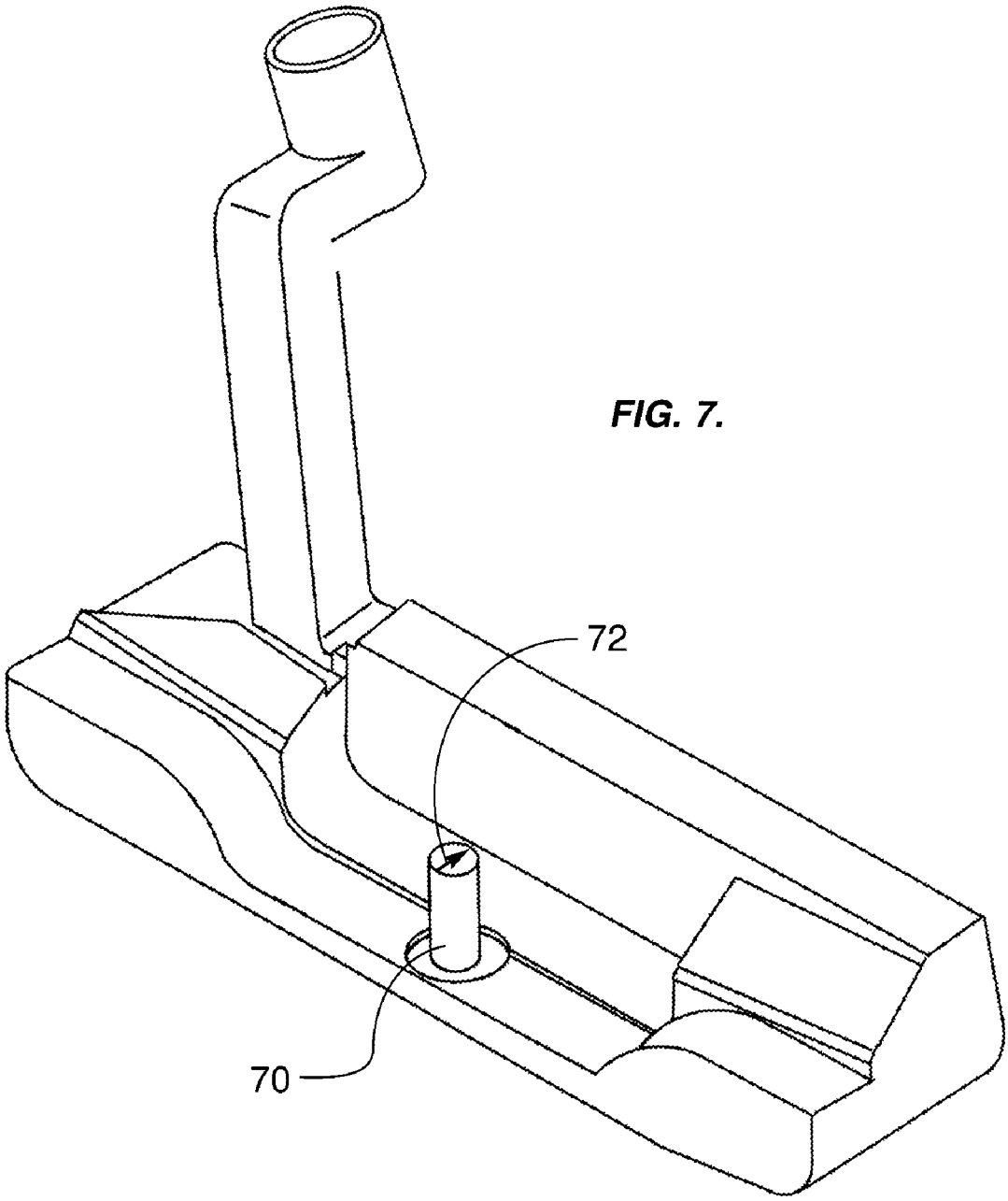
FIG. 7 is a perspective view of an alternate embodiment of the invention.
Figure 8:
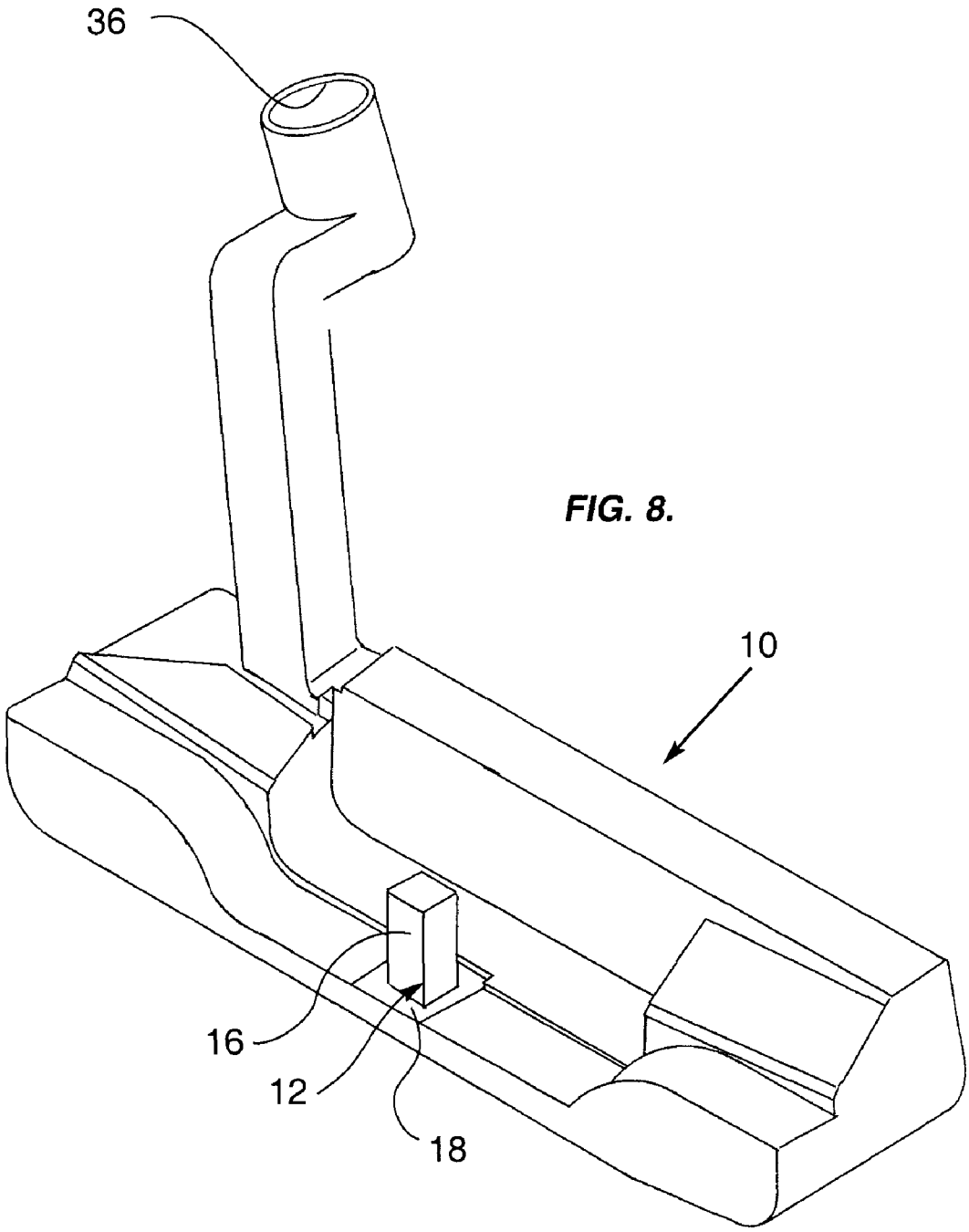
FIG. 8 is a perspective view of the invention.

Upright element 16 includes vertical sides 24. Horizontal base element 18 is symmetrically shaped about bottom 20. In the most preferred embodiment, a top 22 of upright element 16 and base element 18 are of contrasting colors, for example, black and white. In the illustrated embodiment of FIG. 1, upright element 16 presents a square cross section when viewed from above. As shown in FIGS. 6 and 7, other cross sections such as rectangles or circles are certainly possible. Those skilled in the art will recognize that the exact cross section geometry is not critical and many other shapes are certainly contemplated within the scope of the present invention.

In the most preferred embodiment, upright element 16 is positioned in line with the anticipated target line behind sweet spot 25 of putter head 10. Putter head 10, as with all putters, has a striking face 26 and is adapted to be attached to a shaft 30 of a putter. In one illustrated embodiment, a collar 28 is provided to attach to shaft 30 of a putter. In other embodiments, a putter head shaft 32 extends upwardly from putter head 10 to engage a cavity 34 in shaft 30 for attachment. Alternatively, putter head shaft 32 may includes a putter shaft receiving cavity 36. However, those skilled in the art will recognize that the mechanism by which putter head 10 is attached to shaft 30 is not critical to the invention and any suitable attachment device can be employed.

In addition to sighting device 12, an underside 38 of putter head 10 includes flat surface 14. Flat surface 14 is centered under sighting device 12.

To use, a golfer first positions flat surface 14 on the ground or putting green behind a golf ball. Use of flat surface 14 makes certain that putter head 10 is always positioned the same with respect to the ground despite any slope on said ground.

Next, the golfer positions his body using his eyes to center upright element 16 with respect to base element 18. To do so, the golfer makes certain that base element 18 appears completely symmetrical around upright element 16 as best seen in FIG. 1. If not properly aligned with the golfer's eye, one side or another will appear larger or smaller than its opposite side. The golfer moves golfer's eye until base element 18 appears completely symmetrical about upright element 16. If done consistently, the golfer's eyes and head will be in the same position with respect to putter head 10 every time. This mechanism also applies to the embodiment depicted in FIG. 7 having an upright element 70 presenting a circular cross section.

In an alternate embodiment best seen in FIG. 6, a rectangular upright element 60 is partially surrounded on three sides by a corresponding base element 62. The lateral (horizontal and parallel to striking surface 26) sighting mechanism is the same as described above for square upright element 16. For sighting perpendicularly and horizontally, the golfer maximizes the width of a rear portion 64 as seen from above while making certain that no portion of a narrow vertical side 66 of upright element 60 is visible. The embodiment of FIG. 6 also has an advantage in that the long dimension of rectangular upright element 60 provides an aiming mechanism by showing the golfer of the direction that force will be applied to a golf ball by striking surface 26. Other aiming mechanisms are also possible, including indicia 72 atop the upright element pointing in the proper direction.

Figure 1A:
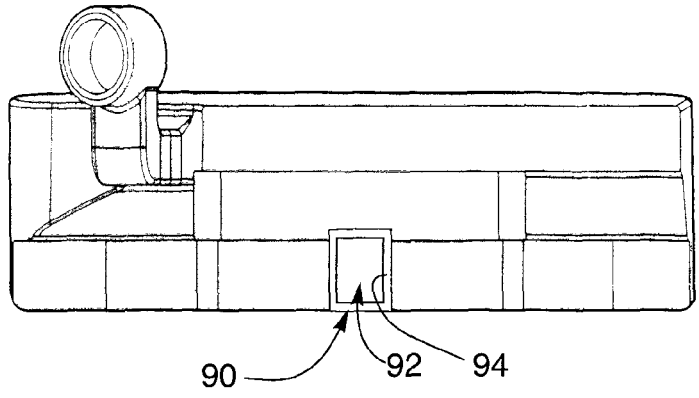
FIG. 1A is a top view of an alternate embodiment of the invention.
Figure 2:
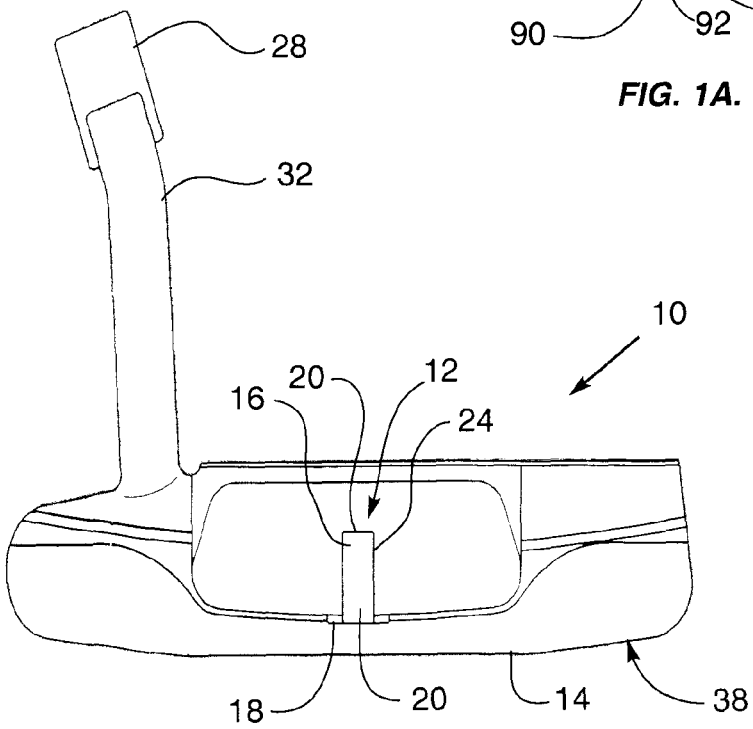
FIG. 2 is a rear view of the invention.
Figure 3:
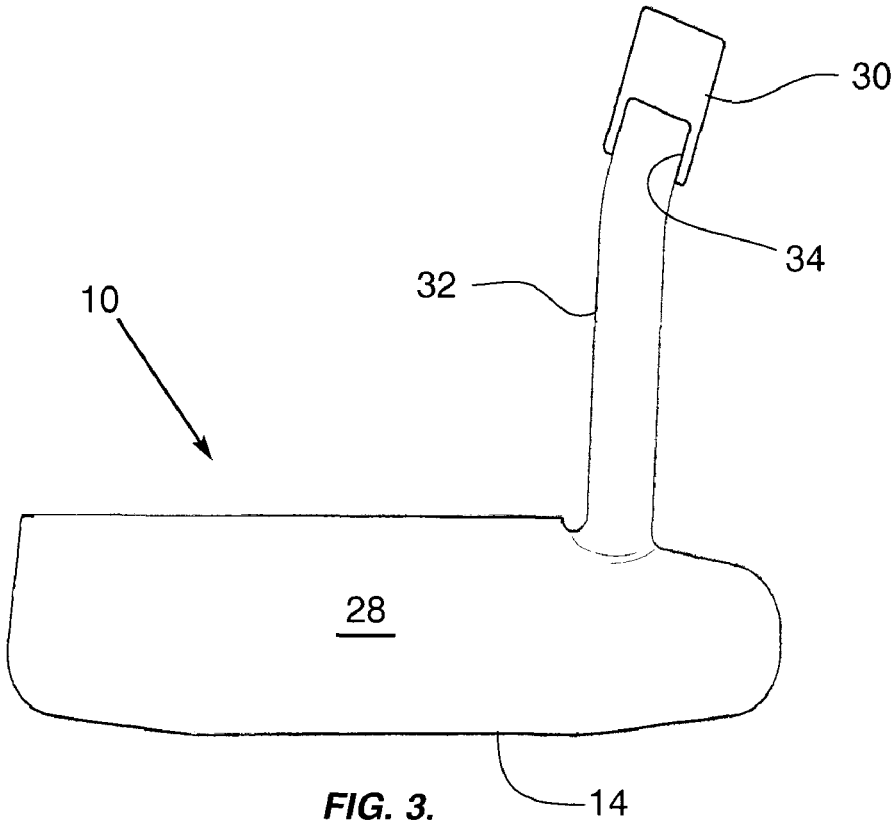
FIG. 3 is a front view of the invention.
Figure 4:
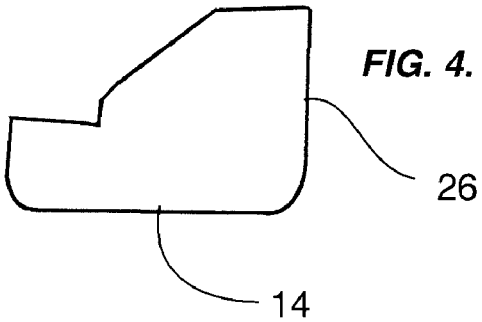
FIG. 4 is a side view of the invention.
Figure 5:
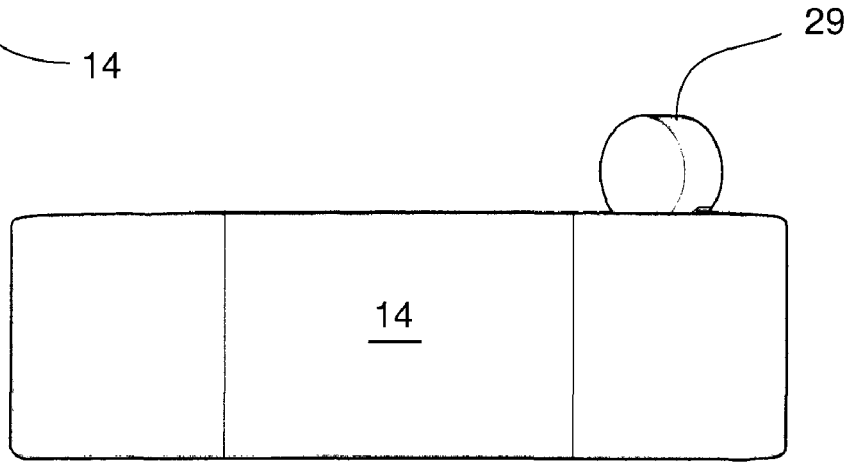
FIG. 5 is a bottom view of the invention.

In still another embodiment best seen in FIG. 1A, a hollow upright element 90 is used for sighting. A square cavity 92 is surrounded by sidewalls 94. To align, the golfer looks down the square cavity 92 and minimizes any view of the sidewalls 94. Other shapes are of course possible with this particular embodiment.

Although only certain embodiments have been illustrated and described, it will be apparent to those skilled in the art that various changes and modifications may be made therein without departing from the spirit of the invention or from the scope of the appended claims.

What is claimed is:

1. A putter head having a striking surface and being adapted to mount to a shaft of a putter, the putter head having an alignment apparatus comprising:

a sighting device, the sighting device having an upright element and a base element, the upright element having a plurality of sidewalls secured to the base element such that each of the plurality of sidewalls extends perpendicularly from the base element and the base element is symmetrically positioned in at least two directions parallel to the ground around a bottom of the upright element, the upright element partially obstructing a view of the base element except in one line extending vertically upward from the upright element whereby when viewed from above, centering the base element around the upright element every time positions a golfer's eyes and head in the same line every time; and a flat surface on the underside of the putter head, the flat surface being centered under the upright element, wherein the base element is parallel to the flat surface on the underside of the putter head, and a rear sidewall of the upright element is oriented perpendicular to the base element and the flat surface, and wherein the rear sidewall defines a plane that is not parallel to a plane defined by the striking surface, whereby positioning the flat surface on a surface positions the putter head in the same relationship with the surface every time.

2. The putter head of claim 1 wherein the upright element and the base element are of contrasting colors.

3. The putter head of claim 1 wherein the upright element has a horizontal square cross section.

4. The putter head of claim 1 wherein the upright element has a horizontal circular cross section.

5. The putter head of claim 1 wherein the upright element has a horizontal rectangular cross section.

6. The putter head of claim 5 wherein one length of the horizontal cross section is directed along an axis perpendicular to the striking face of the putter head and aligned with a sweet spot of the striking face.

7. The putter head of claim 1 wherein the upright element is positioned at a sweet spot of the striking surface.

8. The putter head of claim 1 further including an aiming mechanism showing an axis perpendicular to the striking face of the putter head and aligned with the sweet spot of the striking surface.

9. The putter head of claim 8 wherein the aiming mechanism is indicia atop the upright element.

10. A putter head having a striking surface and being adapted to mount to a shaft of a putter, the putter head having an alignment apparatus comprising:

a sighting device, the sighting device having an upright element and a base element, the upright element having at least three sidewalls secured to the base element such that each of the plurality of sidewalls extends perpendicularly from the base element to the top of the striking surface and the base element is symmetrically positioned in at least two directions parallel to the ground around a bottom of the upright element, the upright element partially obstructing a view of the base element except in one line extending vertically upward from the upright element, the upright element being positioned behind a sweet spot of the striking surface, the upright element and the base element being of contrasting colors, whereby when viewed from above, centering the base element around the upright element every time positions a golfer's eyes and head in the same line every time;

an aiming mechanism which shows the direction of an axis perpendicular to the striking surface of the putter head and aligned with the sweet spot of the striking surface; and a flat surface on the underside of the putter head, wherein the base element is parallel to the flat surface and the flat surface being centered under the upright element whereby positioning the flat surface on a surface positions the putter head in the same relationship with the surface.

11. A putter head having a striking surface and being adapted to mount to a shaft of a putter, the putter head having an alignment apparatus comprising:

a sighting device, the sighting device having an upright element and a base element, the upright element having at least one sidewall secured to the base element such that the at least one sidewall extends perpendicularly from the base element and the base element is symmetrically positioned in at least two directions parallel to the ground around a portion of a bottom of the upright element, the upright element partially obstructing a view of the base element except in one line extending vertically upward from the upright element whereby when viewed from above, centering the base element around the upright element every time positions a golfer's eyes and head in the same line every time; and a flat surface on the underside of the putter head, the flat surface being centered under the upright element, wherein the base element is parallel to the flat surface on the underside of the putter head, and at least one sidewall of the upright element is oriented perpendicular to the base element and the flat surface, and wherein at least one sidewall defines a plane that is not parallel to a plane defined by the striking surface, whereby positioning the flat surface on a surface positions the putter head in the same relationship with the surface every time.

12. The putter head of claim 11 wherein the upright element has a horizontal square cross section.

13. The putter head of claim 11 wherein the upright element has a horizontal circular cross section.

14. A putter head having a striking surface and being adapted to mount to a shaft of a putter, the putter head having an alignment apparatus comprising:

a sighting device, the sighting device having an upright element and a base element, the upright element having at least one sidewall secured to the base element such that the at least one sidewall extends perpendicularly from the base element and the base element is symmetrically positioned in at least two directions parallel to the ground around a bottom of the upright element, the upright element partially obstructing a view of the base element except in one line extending vertically upward from the upright element whereby when viewed from above, centering the base element around the upright element every time positions a golfer's eyes and head in the same line every time;

a flat surface on the underside of the putter head, the flat surface being centered under the upright element whereby positioning the flat surface on a surface positions the putter head in the same relationship with the surface every time, and the flat surface being parallel to the base element;

wherein the upright element has a horizontal rectangular cross section, and one length of the horizontal rectangular cross section is directed along an axis perpendicular to the striking surface and the upright element is positioned at a sweet spot of the striking surface; and wherein the at least one sidewall of the upright element includes a rear sidewall oriented perpendicular to the base element and the flat surface, and the rear sidewall defines a plane that is not parallel to a plane defined by the striking surface.

15. The putter head of claim 14, wherein the base element extends an equal extension distance from each of the at least one sidewall.

16. The putter head of claim 15, wherein a width of the upright element in a heel-to-toe direction is constant and is equal to the base element extension distance.

* * * * *